United States Patent [19]

Marx

[11] Patent Number: 4,896,578

[45] Date of Patent: Jan. 30, 1990

[54] NECK AND BODY ASSEMBLY FOR A STRINGED INSTRUMENT

[76] Inventor: P. J. Marx, 4931 S. Jonathan La., New Berlin, Wis. 53151

[21] Appl. No.: 363,435

[22] Filed: Jun. 6, 1989

Related U.S. Application Data

[63] Continuation of Ser. No. 132,402—ABN.

[51] Int. Cl.[4] ..... G10D 3/00

[52] U.S. Cl. ..... 84/313; 84/291; 84/293

[58] Field of Search ..... 84/267, 291, 293, 313

[56] References Cited

U.S. PATENT DOCUMENTS

| | | | |
|---|---|---|---|
| 3,550,496 | 12/1970 | Fender | 84/293 |
| 3,915,049 | 10/1975 | Bean | 84/1.16 |
| 4,121,492 | 10/1978 | Berardi et al. | 84/293 |
| 4,475,432 | 10/1984 | Stroh | 84/314 N |
| 4,656,916 | 4/1987 | Gressett | 84/313 |

*Primary Examiner*—Lawrence R. Franklin

*Attorney, Agent, or Firm*—Andrus, Sceales, Starke & Sawall

[57] ABSTRACT

An apparatus for joining the neck and body of a stringed instrument includes a connecting flange of reduced thickness at the base of the neck and a cavity in the upper portion of the body for receiving the connecting flange and creating a junction having a thickness substantially equal to that of the base of the neck.

5 Claims, 2 Drawing Sheets

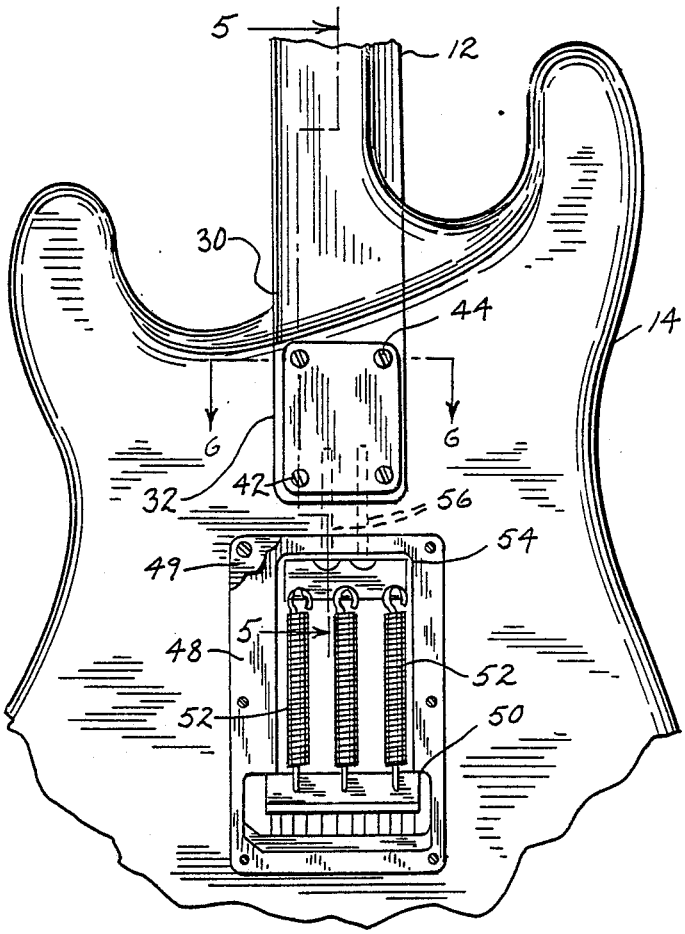
FIG. 4
FIG. 5
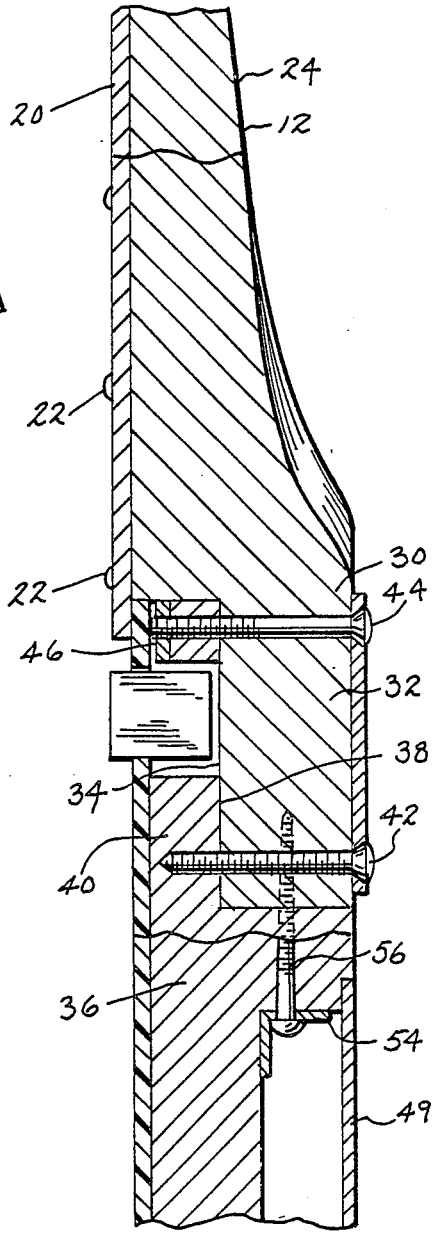
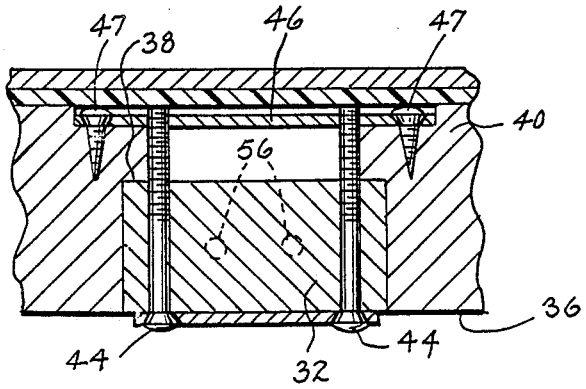
FIG. 6

NECK AND BODY ASSEMBLY FOR A STRINGED INSTRUMENT

This is a continuation of co-pending application Ser. No. 07/132,402 filed Dec. 14, 1987.

BACKGROUND OF THE INVENTION

The present invention relates to an assembly for joining the neck and body of a stringed instrument and more particularly to an assembly for releasably connecting the neck and body portions of an electrical guitar.

Prior art electrical guitars fastened the base portion of the neck to the front of the body of the guitar. The mass of the guitar body behind the neck made it very difficult, if not impossible, to reach and finger frets located at the base of the neck.

Also, with the neck located on the front of the body the tension created by the strings tended to cause separation of the neck from the body.

In electrical guitars that utilized a tremolo spring cavity, the tremolo spring claw assembly was anchored by a plurality of fasteners that were imbedded in the body of the instrument. The anchoring of these fasteners into the middle of the body caused a dumping of some of the vibrational energy of the strings into a dead zone of the body.

It is an object of the present invention to provide an assembly for joining the neck and body of an electrical guitar which greatly reduces the thickness in the connection area and thus allows for ease of access to the frets located at the base of the neck.

It is also an object of the present invention to provide a neck and body assembly that allows for the anchoring of the tremolo spring claw assembly into the neck so that the vibration of the strings is conducted back into the neck and ultimately back into the vibrating strings in order to increase the overall sustain of the instrument.

SUMMARY OF THE INVENTION

An assembly for joining the neck and body of a stringed instrument includes an elongated neck in which the base end of the neck has a connecting flange extending therefrom with the connecting flange having a reduced thickness.

In accordance with one aspect of the invention, the body is provided with an upper portion of reduced thickness which overlaps and abuts the connecting flange when the neck is joined to the body so that the combined thickness of the upper body portion and the connecting flange is substantially the same as the thickness of the base end of the neck.

In accordance with another aspect of the invention, where the instrument includes a tremolo spring claw assembly, the spring claw assembly is connected to the connecting flange of the neck.

The present invention thus provides an instrument in which the connection between the neck and the body does not interfere with the access to the frets located at the base of the neck.

The present invention also provides an instrument in which the vibration of the strings is conducted through the tremolo spring claw assembly, into the neck and back into the strings.

BRIEF DESCRIPTION OF THE DRAWINGS

The drawings illustrate the best mode presently contemplated of carrying out the invention.

In the drawings:

FIG. 4 is a rear plan view with parts broken away of the guitar of FIG. 1;

FIG. 5 is a section taken along line 5—5 of FIG. 4; and

FIG. 6 is a section taken along line 6—6 of FIG. 4.

DETAILED DESCRIPTION OF THE INVENTION

Figure 1:
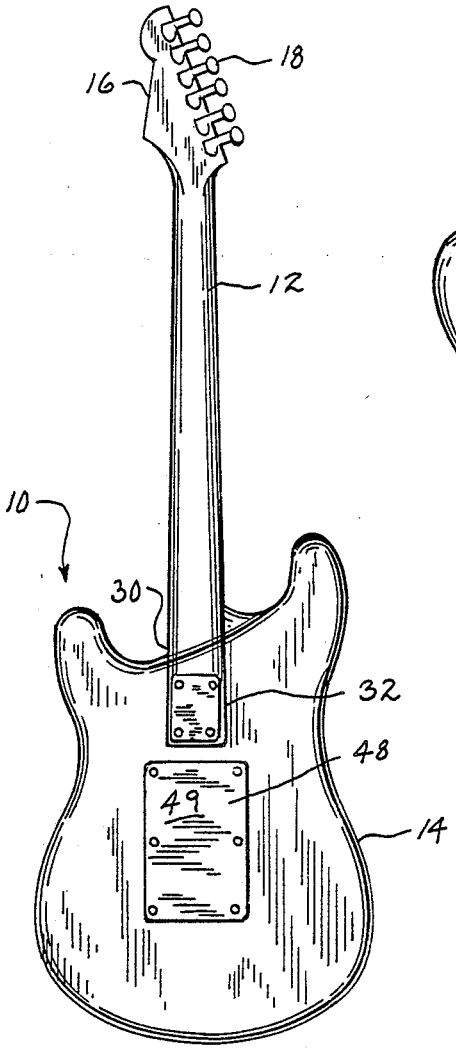
FIG. 1 is a rear plan view of an electrical guitar constructed according to the present invention.

As shown in FIG. 1, an electrical guitary 10 includes a neck 12 secured to a body 14.

Neck 12 includes an outer end 16 having adjustment screws 18 which are rotated to adjust the tension in the strings (not shown). Neck 12 further includes a front surface 20 along which the strings are disposed over a plurality of frets 22 and a rear surface 24 which is configured so as to accommodate the hand of the player.

Figure 2:
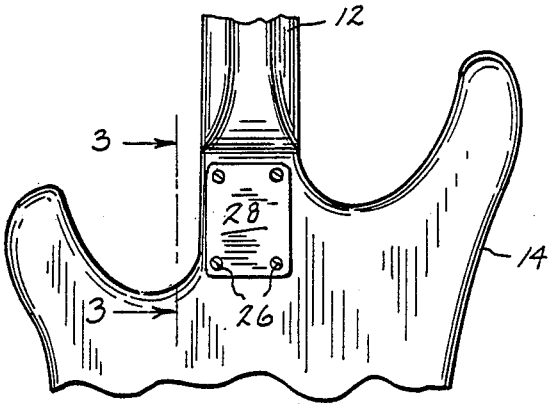
FIG. 2 PRIOR ART
FIG. 2 is a partial rear view of the neck and body connection of a prior art guitar.
Figure 3:
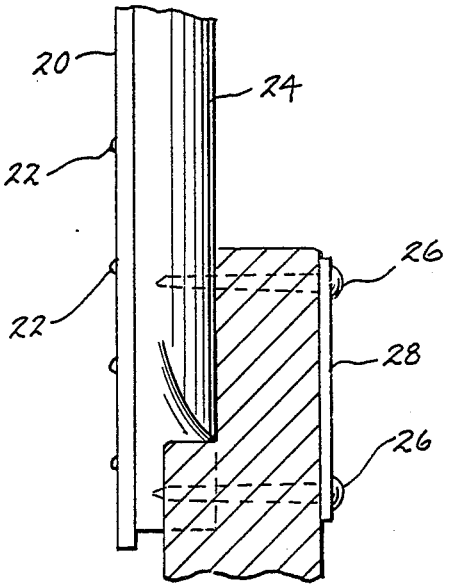
FIG. 3 PRIOR ART
FIG. 3 is a section taken along line 3—3 of FIG. 2.

As shown in FIGS. 2 and 3, prior art guitars connected the neck 12 to the front of the body 14 by means of a plurality of screws 26 that were inserted through a cover plate 28, through body 14 and into neck 12. As can be seen in FIG. 3, this prior art method of connecting neck 12 to body 14 resulted in an area of enlarged thickness at the juncture point. This enlarged thickness of the instrument at this point made it extremely difficult for the player to reach frets 22 located at the base of the neck 12.

In the present invention the base 30 of neck 12 has been provided with a connecting flange 32 that extends downwardly from base 30 so as to extend rear surface 24 beyond front surface 20 and form a forwardly facing hollow 34 below base 30. While connecting flange 32 is shown as integral with neck 12 and of the same material, it is envisioned that flange 32 could be a separate piece and of a different material. The upper portion 36 of body 14 is provided with a rearwardly facing cavity 38 that accommodates connecting flange 32. The formation of cavity 38 results in an upper body portion 40 of reduced thickness, thus, when connecting flange 32 is placed within cavity 38 the combined thickness of body portion 40 and connecting flange 32 is substantially equal to that of neck base 30 so as to allow ease of access to frets 22.

In FIG. 5, connecting flange 32 is shown connected to upper base portion 40 by a pair of wood screws 42 that pass through connecting flange 32 and into body portion 40 and a pair of machine screws 44 that pass through connecting flange 32 and upper body portion 40 and are anchored in steel plate 46 which has been inlaid on the face of upper body portion 40 bymeans of screws 47. This method of passing the fasteners through the neck and into the body results in a much stronger joint than the prior art method of passing the screws through the body and into the neck.

FIGS. 4 and 5 illustrate an electrical guitar 10 that has been provided with a cavity 48 in which is disposed the tremolo spring block assembly 50 and which is normally closed by plate 49. Tremolo block assembly 50 is operatively connected to the string bridge on the front surface of body 14 and movement of tremolo block assembly 50 results in a movement of the string bridge (not shown) which effectively changes the pitch of the instrument. The movement of tremolo block assembly 50 is caused by a handle (not shown) and the amount of force needed to move assembly 50 is determined by the tension in springs 52. In the prior art a pair of adjustable screws would be connected to the bracket 54 containing springs 52 and the threaded ends of the screws would be embedded in body 14. Rotation of the screws would cause movement of bracket 54 and a resulting change in the tension in springs 52.

In the present invention, bracket 54 is anchored into the base of connecting flange 32 by a pair of threaded fasteners 56. Thus, the vibrational energy transferred from the strings to block assembly 50 is in turn transferred into neck 12 via connecting flange 32 and eventually back into the strings. In the prior art method of anchoring the tremolo spring claw assembly, the vibrational energy simply dumped into the dead zone of the body.

Various modes for carrying out the invention are contemplated as being within the scope of the following claims particularly pointing out and distinctly claiming the subject matter which is regarded as the invention.

I claim:

1. An assembly for joining the neck and body of a stringed instrument comprising:

an elongated neck having a front surface along which the strings are disposed and a rear surface configured so as to accommodate the hand ofthe user, the base end of said neck having a first thickness measured from said front surface to said rear surface and having a connecting flange extending therefrom with said connecting flange having a second thickness smaller than said first thickness, a body having a front surface along which the strings are disposed and a rear surface facing the user, said body having an upper connecting portion adapted to mate with said connecting flange in such a manner that said connecting portion overlaps and abuts said connecting flange and defines a combined thickness of said upper connecting portion and connecting flange which is substantially the same as said first thickness of said base end, said body further including a rearwardly opening cavity in which is disposed a tremolo block assembly and further comprising fastener means for connecting said block assembly to said connecting flange, said fastener means consisting of screw means connecting said block assembly to said connecting flange, and fastening means extending through said connecting flange and into said connecting portion to secure said upper body connecting portion to said connecting flange.

2. The assembly defined in claim 1 wherein said connecting flange comprises a portion of said neck extending the rear surface of said neck beyond the front surface of said neck so that a forwardly facing hollow is formed in said neck.

3. The assembly defined in claim 1 wherein said upper connecting portion comprises a rearwardly facing cavity disposed in the rear surface of said body and said connecting flange is disposed within said cavity.

4. The assembly defined in claim 1 wherein said fastener means for connecting said block assembly to said connecting flange is disposed substantially perpendicular to said fastening means securing said upper body portion to said flange.

5. An assembly for joining the neck and body of a stringed instrument comprising:

an elongated neck having a front surface along which the strings are disposed and a rear surface configured so as to accommodate the hand of the user, the base end of said neck having a first thickness measured from sadi front surface to said rear surface and having a connecting flange extending therefrom with said connecting flange having a second thickness smaller than said first thickness, a body having a front surface along which the strings are disposed and a rear surface facing the user, said body having a rearwardly facing cavity disposed in the rear surface of said body and said connecting flange is disposed within said cavity so that the combined thickness of said body and said connecting flange contained in said body cavity is substantially the same as said first thickness, said body further including a rearwardly opening cavity in which is disposed a tremolo block assembly and further comprising fastener means for connecting said block assembly to said connecting flange, said fastener means consisting of screw means connecting said block assembly to said connecting flange, and fastening means extending through said connecting flange and into said body to secure said neck to said body.

* * * * *